US012235071B2

(12) United States Patent
Martz et al.

(10) Patent No.: US 12,235,071 B2
(45) Date of Patent: Feb. 25, 2025

(54) SYSTEMS AND METHODS FOR AN ADJUSTABLE WEIGHT ASSEMBLY FOR A FIREARM

(71) Applicant: Daniel Defense, LLC, Black Creek, GA (US)

(72) Inventors: Parker Scott Martz, Knoxville, TN (US); Daniel Eric McLeroy, Savannah, GA (US)

(73) Assignee: Daniel Defense, LLC, Black Creek, GA (US)

( * ) Notice: Subject to any disclaimer, the term of this patent is extended or adjusted under 35 U.S.C. 154(b) by 151 days.

(21) Appl. No.: 17/809,631

(22) Filed: Jun. 29, 2022

(65) Prior Publication Data

US 2024/0003656 A1 Jan. 4, 2024

(51) Int. Cl.
*F41C 27/22* (2006.01)
*F41C 23/16* (2006.01)

(52) U.S. Cl.
CPC ..... *F41C 27/22* (2013.01); *F41C 23/16* (2013.01)

(58) Field of Classification Search
CPC ..... F41C 27/22; F41C 23/16
See application file for complete search history.

(56) References Cited

U.S. PATENT DOCUMENTS 2,414,250 A * 1/1947 Williams ..... F41C 23/16 89/14.3
2,921,396 A * 1/1960 Larson ..... F41C 27/22 42/97
7,231,861 B1 * 6/2007 Gauny ..... F41A 3/72 89/1.4
8,028,611 B2 * 10/2011 Loundsbury ..... F41G 3/12 42/1.06
8,726,558 B1 * 5/2014 Nason ..... F41G 11/003 42/71.01
D715,393 S * 10/2014 Williams ..... D22/109
8,925,236 B1 * 1/2015 Mayberry ..... F41G 11/004 42/124
9,568,282 B1 * 2/2017 Schorman ..... G03B 17/561
9,599,439 B1 * 3/2017 Sylvester ..... F41G 11/003
9,995,557 B2 * 6/2018 Geissele ..... F41C 23/16
10,001,341 B2 * 6/2018 Geissele ..... F41C 27/22
10,184,752 B2 * 1/2019 Tubb ..... F41A 21/44
10,317,163 B2 * 6/2019 Poindexter ..... F41A 23/02
10,352,649 B2 * 7/2019 Beaty ..... F41C 23/16
10,551,145 B2 * 2/2020 Kincel ..... F41C 23/16
11,125,530 B2 * 9/2021 Kincel ..... F41C 23/16
11,402,174 B2 * 8/2022 Angle ..... F41C 27/22
11,656,059 B1 * 5/2023 Ding ..... F41C 23/16 42/71.01
11,754,363 B1 * 9/2023 Hodgson ..... F41A 27/28 235/407
11,828,556 B2 * 11/2023 Paspaliaris ..... F41A 21/30
11,874,086 B2 * 1/2024 Kincel ..... F41C 23/16
2004/0009034 A1 * 1/2004 Miller ..... F41G 11/003 403/363

(Continued)

*Primary Examiner* — Michelle Clement
(74) *Attorney, Agent, or Firm* — Kim and Lahey Law Firm, LLC; Douglas W. Kim

(57) ABSTRACT

Systems and methods for adjusting a weight, center of gravity, and balance point of a firearm are disclosed. The systems and methods include a handguard, a weight configured to be attached to the handguard, and a firearm accessory configured to be adjustably secured about the weight.

18 Claims, 4 Drawing Sheets

(56) References Cited

U.S. PATENT DOCUMENTS

| | | | | |
|---|---|---|---|---|
| 2010/0154280 | A1* | 6/2010 | LaFrance | F41H 5/12 42/106 |
| 2010/0170133 | A1* | 7/2010 | Swan | F41C 23/02 42/90 |
| 2015/0007476 | A1* | 1/2015 | Dextraze | F41C 23/16 42/71.01 |
| 2016/0097611 | A1* | 4/2016 | Sharron | F41C 27/00 42/90 |
| 2018/0120053 | A1* | 5/2018 | Kolb | F41C 23/02 |
| 2021/0372736 | A1* | 12/2021 | Zhou | F41G 1/35 |
| 2023/0221097 | A1* | 7/2023 | Melville | F41G 11/003 42/90 |
| 2023/0349658 | A1* | 11/2023 | Gomez | F41A 21/00 |

* cited by examiner

SYSTEMS AND METHODS FOR AN ADJUSTABLE WEIGHT ASSEMBLY FOR A FIREARM

FIELD

The disclosure generally relates to firearm accessories and more particularly relates to systems and methods for an adjustable weight assembly for a firearm.

BACKGROUND

A properly balanced firearm may increase the comfort and accuracy of the user. Firearms may include a number of accessories attached thereto. The addition of various accessories, however, may change the weight, center of gravity, and/or balance point of the firearm, which may be undesirable. Thus, a system that provides for adjustability and versatility of the weight, center of gravity, and/or balance point of the firearm may be useful.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Described below are embodiments of an adjustable weight assembly for a handguard of a firearm. Methods of manufacturing and using the adjustable weight assembly are also disclosed.

In certain embodiments, the adjustable weight assembly may include a handguard, a weight configured to be attached to the handguard, and a firearm accessory configured to be adjustably secured about the weight. In some instances, the weight includes a slot, and the adjustable weight assembly may further include a tab configured to be adjustably secured about the slot. For example, the slot may include a lip forming a channel. The tab may be configured to be (i) movably disposed within the channel between the lip and the handguard in a first configuration and (ii) securely sandwiched within the channel between the lip and the handguard in a second configuration. In some instances, a width of the tab may be larger than a width of the channel. In this manner, a weight distribution of the firearm may be adjusted by attaching the weight to the handguard and/or adjusting a position of the firearm accessory about the weight.

Figure 1A:
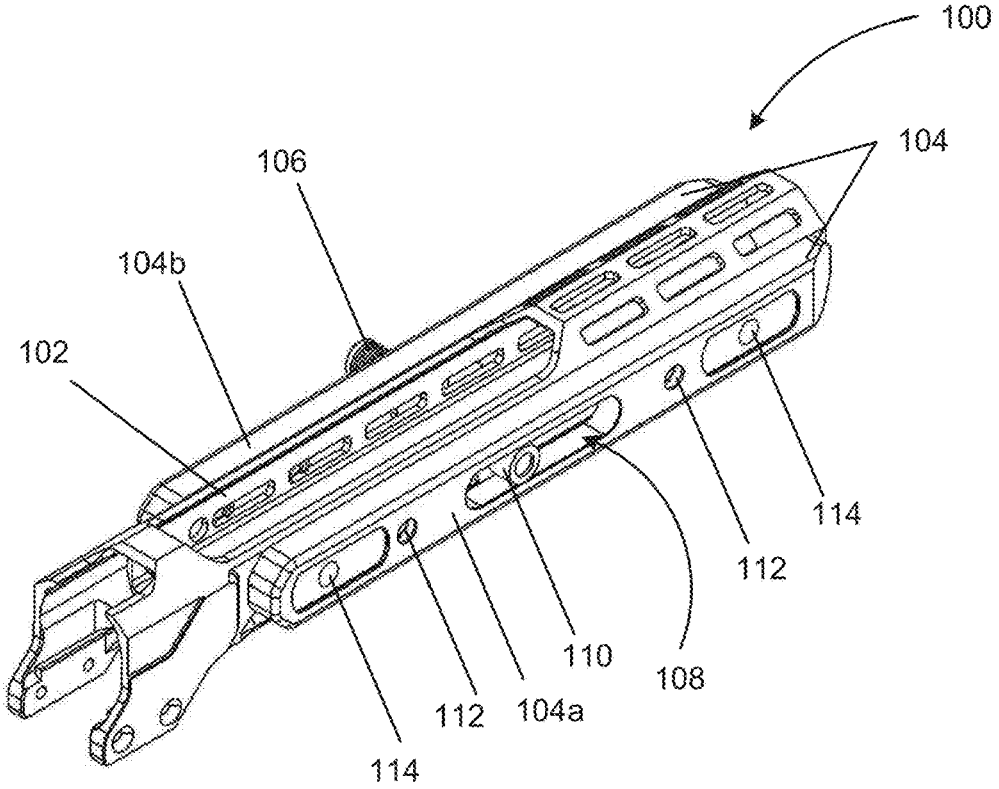
FIGS. 1A and 1B are perspective views of an adjustable weight assembly on a handguard of a firearm in accordance with one or more embodiments of the disclosure.
Figure 1B:
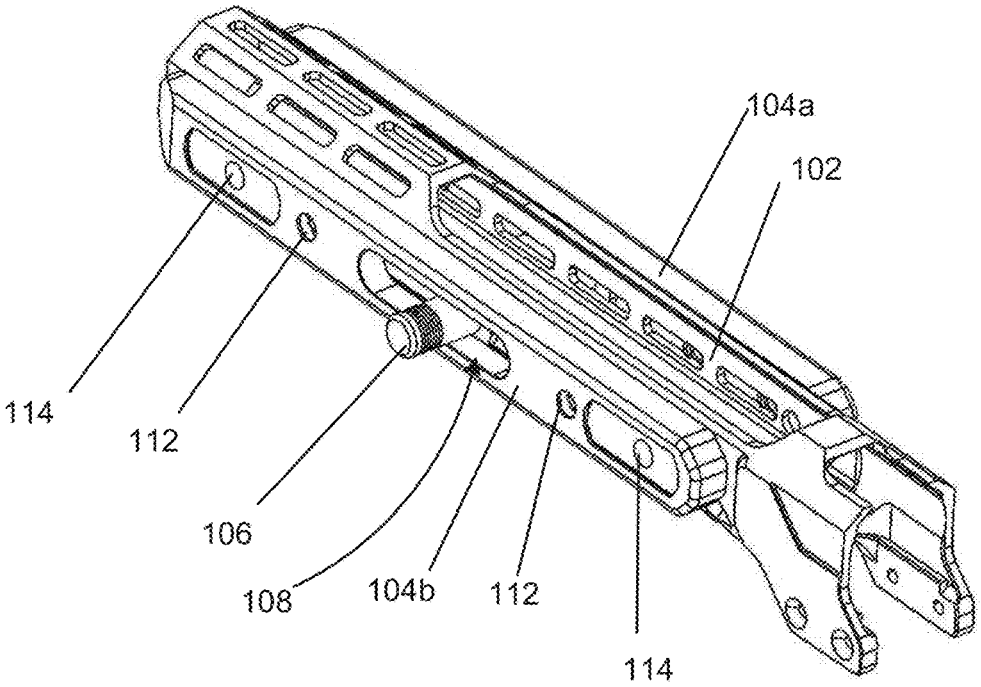

Turning now to the drawings, FIG. 1A depicts an embodiment of an adjustable weight assembly 100. The adjustable weight assembly 100 may be mounted onto a handguard 102 or the like. In some embodiments, the handguard 102 may have an M-Lok® interface, a Picatinny interface, a keymod interface, or any other suitable interface or combinations thereof that are suitable for mounting accessories. The handguard 102 may be any suitable size, shape, or configuration.

The adjustable weight assembly 100 may include weights 104 comprising a first weight 104*a* and a second weight 104*b*. Any number of weights 104 may be used herein. The weights 104 may be removably coupled to the handguard 102. In some instances, the weights 104 may be substantially the same length as the handguard 102. The weights 104 may be any suitable size, shape, or configuration.

In certain embodiments, the first weight 104*a* may be disposed on a first side of the handguard 102, and the second weight 104*b* may be disposed on a second side of the handguard 102. The weights 104 may be disposed at any suitable location on the handguard 102. In some instances, the first weight 104*a* and the second weight 104*b* may be substantially identical. In other instances, the first weight 104*a* and the second weight 104*b* may be different sizes, different weights, and/or different configurations. In certain embodiments, the first weight 104*a* and the second weight 104*b* may each have a front side, a rear side, and a slot. For example, the first weight 104*a* may include a slot 108, and the second weight 104*b* may include a slot 108. The slots 108 may be configured to house an accessory that is configured to be adjustably secured within the slots 108.

Figure 2A:
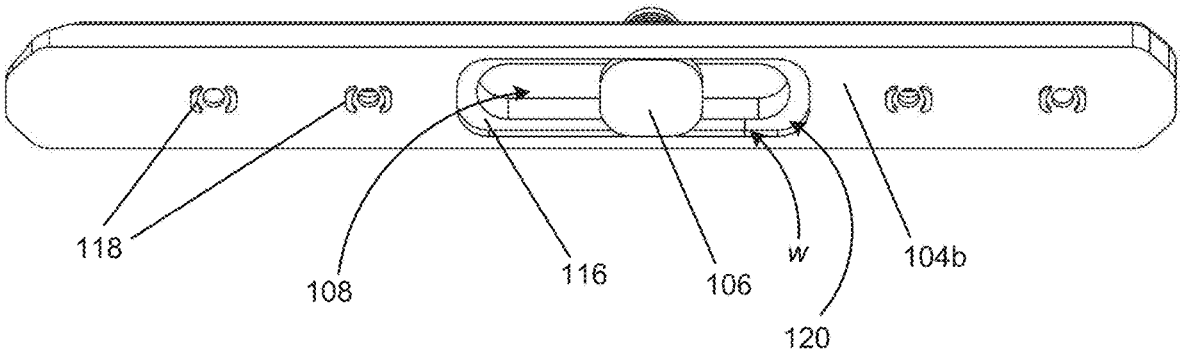
FIGS. 2A, 2B, and 2C are a views of an adjustable weight assembly in accordance with one or more embodiments of the disclosure.
Figure 2B:
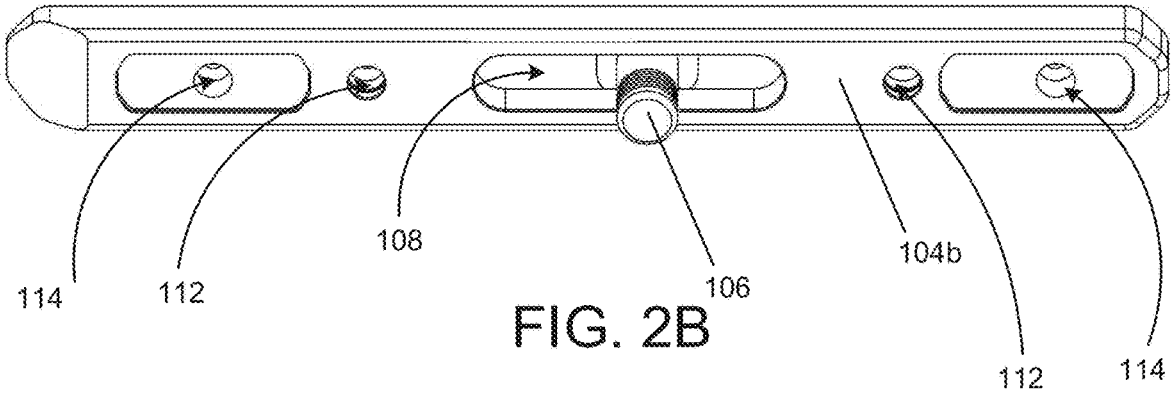

As shown in FIG. 2A, the weights 104 may have at least one mount 118 to secure the weights 104 to the handguard 102. In some instances, the weights 104 may include a plurality of mounts 118 to secure the weights 104 to the handguard 102. Any number of mounts 118 may be used herein. The size and shape of the mounts 118 may correspond to the handguard 102 interface.

In some embodiments, the first weight 104*a* may have at least one hole 114 for securing the weight 104*a* to the handguard 102. Any number of holes 114 may be used herein. The size and shape of the holes 114 may correspond to the handguard 102 interface. In some instances, the hole 114 may have a screw or other fastener inserted therethrough and into the handguard 102 to secure the weight 104*a* onto the handguard 102. In some embodiments, the first weight 104*a* may have a plurality of holes 114 for securing the first weight 104*a* to the handguard 102. A first hole 114 may be positioned at the front of the handguard 102, and a second hole 114 may be positioned at the rear of the handguard 102.

The first weight 104*a* may also have at least one quick detach mount 112. In some embodiments, the first weight 104*a* has a first quick detach mount 112 and a second quick detach 112 mount on either side of the slot 108. The first weight 104*a* may also include an accessory 110 disposed within the slot 108 that includes a quick detach mount 206. The accessory 110 is configured to be adjustably secured within the slot 108. The quick detach mounts 112, 206 may be counter bored for easy connected and detachment of accessories. In some embodiments, the quick detach mounts 112 may also have a screw or other fastener inserted therethrough and into the handguard 102 to secure the first weight 104*a* onto the handguard 102.

In some embodiments, the first weight 104*a* may comprise any number of holes 114 and/or quick detach mounts 112 in the side of the weight. The first weight 104*a* may use either the holes 114, the quick detach mounts 112, or both to secure the first weight 104*a* to the handguard 102 by insertion of a screw or fastener therethrough. In some embodiments, there are an equal number of holes 114 and quick detach mounts 112 on either side of the slot 108.

In some embodiments, the second weight 104*b* may have at least one hole 114 for securing the second weight 104*b* to the handguard 102. Any number of holes 114 may be used herein. The size and shape of the holes 114 may correspond to the handguard 102 interface. In some instances, the holes 114 may have a screw or other fastener inserted therethrough and into the handguard 102 to secure the second weight 104*b* onto the handguard 102. In some embodiments, the second weight 104*b* may have a plurality of holes 114 for securing the second weight 104*b* to the handguard 102. A first hole 114 may be positioned at the front of the handguard 102, and a second hole 114 may be positioned at the rear of the handguard 102.

The second weight 104*b* may also have at least one quick detach mount 112. In some embodiments, the second weight 104*b* may include a first quick detach mount 112 and a second quick detach 112 mount on either side of the slot 108. The second weight 104*b* may also include an accessory 110 disposed within the slot 108 that includes a quick detach mount 206. The accessory 110 is configured to be adjustably secured within the slot 108. The quick detach mounts 112, 206 may be counter bored for easy connected and detachment of accessories. In some embodiments, the quick detach mounts 112 may also have a screw or other fastener inserted therethrough and into the handguard 102 to secure the second weights 104*b* onto the handguard 102.

Figure 3A:
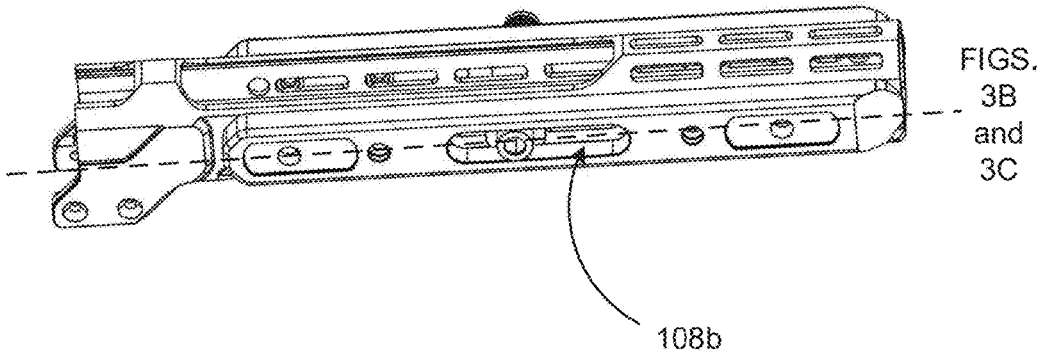
FIG. 3A is a perspective view of an adjustable weight assembly on a handguard of a firearm in accordance with one or more elements of the disclosure.
Figure 3B:
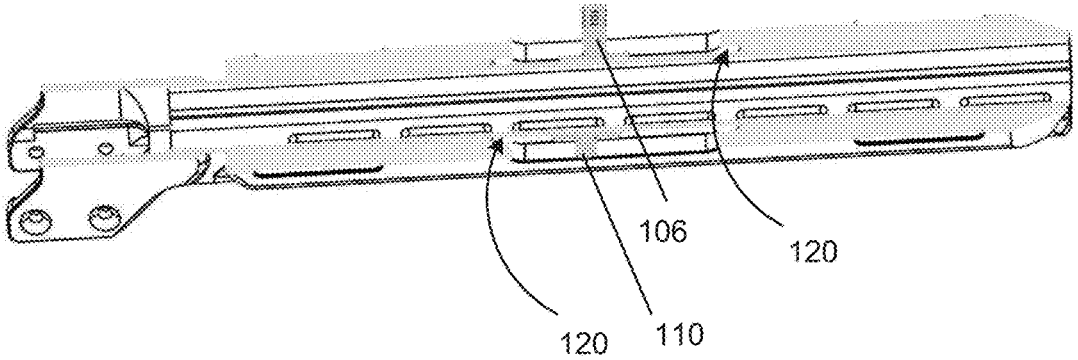
FIG. 3B is a cross section of the adjustable weight assembly on a handguard of a firearm of FIG. 3A with the accessories in a first position in accordance with one or more elements of the disclosure.
Figure 3C:
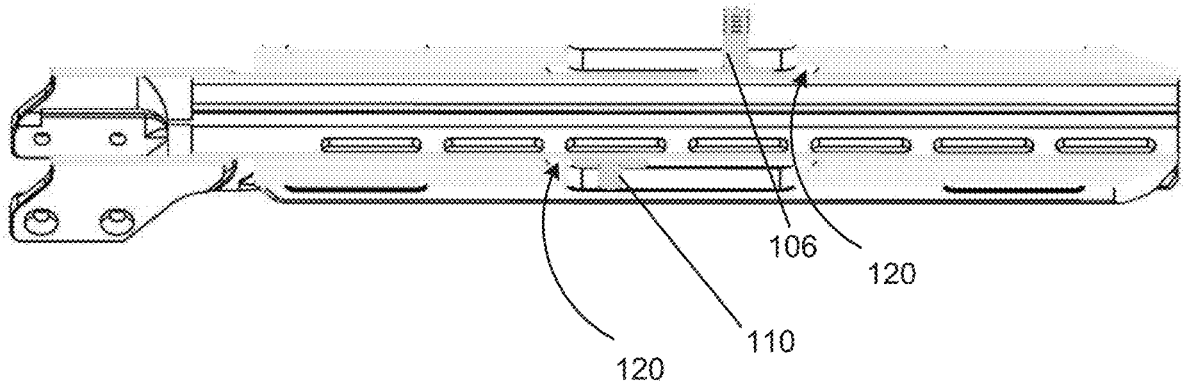
FIG. 3C is a cross section of the adjustable weight assembly on a handguard of a firearm of FIG. 3A with the accessories in a second position in accordance with one or more elements of the disclosure.

In some embodiments, as shown in FIG. 2A, the slots 108 may include a lip 116 on the inside surface of the weights 104. As shown in FIGS. 3B and 3C, the lip 116 may create a channel 120 when the weights 104 are secured to the handguard 102. An accessory 106 or an accessory 110 may be disposed within the slots 108. The accessories 106, 110 are configured to be slid along the channel 120 when the weights 104 are not tightly secured against the handguard 102.

Figure 2C:
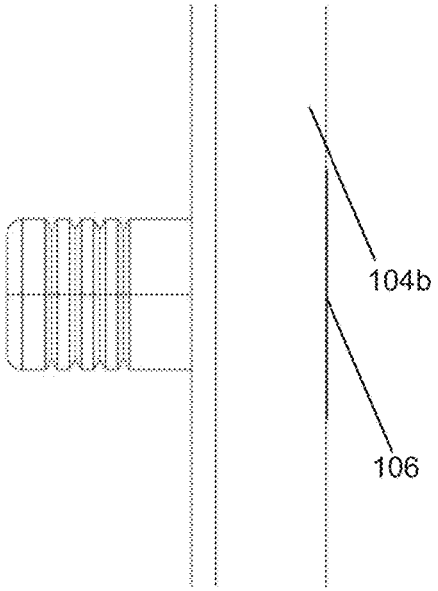
Figure 4A:
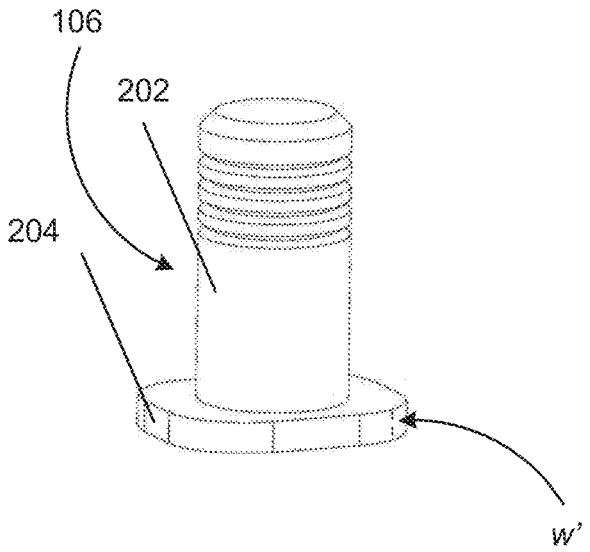
FIGS. 4A and 4B are views of an adjustable accessory in accordance with one or more elements of the disclosure.
Figure 4B:
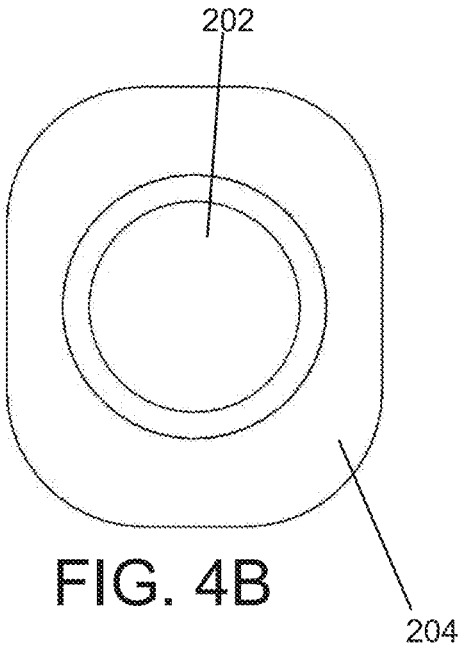

The accessory 106, as shown by FIGS. 4A and 4B, has a tab 204 connected to a shaft 202. The shaft 202 may comprise an elongated solid portion with a textured tip or sides to allow for easier grasping. The accessory 106 may be slid forward and backward relative to the weights 104 within the slots 108 as shown in FIGS. 3B and 3C. The position of the accessory 106 may allow for a user to grasp the shaft 202 portion at different points of the handguard 102. The tab 204 may have a width w' as shown in FIG. 4A. The width w' of the tab may be greater than the width w of the channel as shown in FIG. 2A. The width w' of the tab being greater than the width w of the channel results in some of the tab 204 extending beyond the backside of the weights 104, as shown in FIG. 2C. In this manner, the tab 204 can be tightened against the handguard 102 in the channel 120 when the weights are tightly secured to the handguard 102.

As depicted in FIG. 3B, the accessory 106 is in a first position in the middle of the slot 108 in the channel 120, and in FIG. 3C the accessory 106 is in a second position toward the front of the slot 108 in the channel 120. The accessory 106 may be located at any location within the slot 108. As shown in FIG. 2C, the tab 204 has a greater width than the channel 120 and extends beyond a backside of the weight 104, so that when the weight 104 is tightened, the tab 204 is held in place by frictional pressure, or sandwiched between the handguard 102 and lip 116.

As shown in FIGS. 4A and 4B, the accessory 106 has a shaft 202 and a tab 204. The width w' of the tab 204 is wider than the width of the channel 120 w, thus securing the tab 204 within the slot 108. The shaft 202 may have a textured surface for easier gripping. The shaft 202 may extend out the slot 108 for easier sliding of the tab 106 along the channel 120.

Figure 4C:
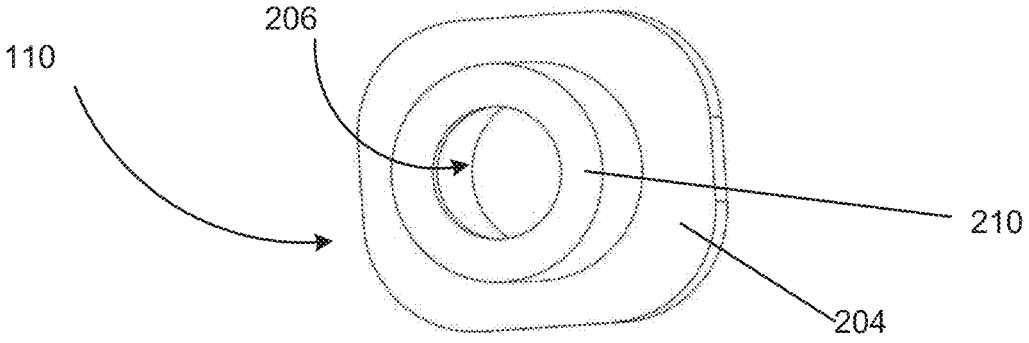
FIGS. 4C and 4D are views of an adjustable accessory in accordance with one or more elements of the disclosure.
Figure 4D:
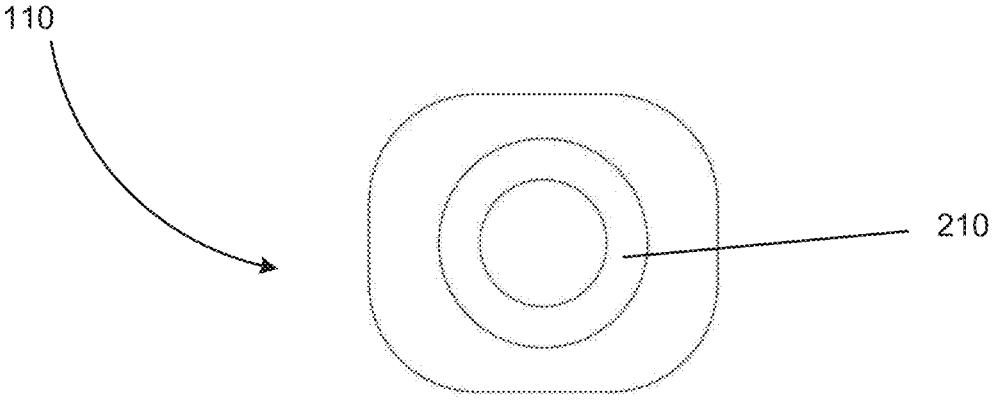

As shown in FIGS. 4C and 4D, the accessory 110 has a shaft 210 and a tab 204. Within the shaft 210 is an aperture 206 for quickly securing and removing other accessories. The width w' of the tab 204 is wider than the width of the channel 120 w, thus securing the accessory 110 within the slot 108. The shaft 210 may extend out the slot 108 for easier sliding of the accessory 110 along the channel 120.

The accessories 106, 110 can be substituted for various other accessories or mounts including, but not limited to, side mounted sights, lasers, guides, lights, or other firearm accessories. The addition of the weights 104 and the adjustability of the accessories 106, 110 enables a user to adjust a weight, center of gravity, and balance point of a firearm by adding the weights 104 and adjusting the accessory 106, 110 along the slot 108.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A system for a firearm, comprising:

a handguard;

a weight configured to be attached to the handguard;

an accessory slot defined in the weight;

a firearm accessory disposed external to the handguard and extending through the weight;

a tab included in the firearm accessory and sandwiched between the handguard and the weight; and, the firearm accessory is configured to be adjustably secured about the weight.

2. The system of claim 1, wherein the weight a quick detach mount.

3. The system of claim 2, wherein the firearm accessory comprises a tab configured to be adjustably secured about the accessory slot.

4. The system of claim 3, wherein the slot comprises a lip forming a channel.

5. The system of claim 4, wherein the tab is configured to be movably disposed within the channel between the lip and the handguard in a first configuration.

6. The system of claim 5, wherein the tab is configured to be securely sandwiched within the channel between the lip and the handguard in a second configuration.

7. The system of claim 3, wherein a width of the tab is larger than a width of the channel.

8. The system of claim 1, wherein the weight is configured to be attached to the handguard through a quick detach mount formed on the weight.

9. A method for adjusting a weight distribution of a firearm, the method comprising:

attaching a weight to a handguard;

adjusting a position of a firearm accessory about the weight;

providing a firearm accessory having a tab disposed between the handguard and the weight wherein the tab includes a shaft extending out of the weight.

10. The method of claim 9, wherein the weight includes a slot defined in the weight and adapted to received a firearm accessory.

11. The method of claim 10, wherein the firearm accessory wherein the tab is configured to be adjustably secured about the slot.

12. The method of claim 11, wherein the slot comprising a lip forming a channel.

13. The method of claim 12, wherein the tab is configured to be movably disposed within the channel between the lip and the handguard in a first configuration.

14. The method of claim 13, wherein the tab is configured to be securely sandwiched within the channel between the lip and the handguard in a second configuration.

15. The method of claim 11, wherein a width of the tab is larger than a width of the channel.

16. A system for adjusting a weight distribution of a firearm, comprising:

a weight configured to be attached to a handguard, wherein the weight comprises a slot;

a firearm accessory configured to be adjustable secured about the weight, wherein the firearm accessory comprises a tab configured to be adjustably secured about the slot and wherein the firearm accessory extends from the handguard through the weight;

wherein the tab is configured to be movably disposed within the channel between the lip and the handguard in a first configuration; and, wherein the tab is configured to be securely sandwiched within the channel between the lip and the handguard in a second configuration.

17. The system of claim 16, wherein the slot comprising a lip forming a channel.

18. The system of claim 16, wherein a width of the tab is larger than a width of the channel.

* * * * *